US006397416B2

(12) United States Patent
Brooke et al.

(10) Patent No.: US 6,397,416 B2
(45) **Date of Patent: *Jun. 4, 2002**

(54) AMBULATORY ASSIST ARM FOR A BED

(75) Inventors: Jason C. Brooke, Mount Pleasant; Kendall O. Shows; William S. Larisey, Jr., both of Summerville, all of SC (US); Robert E. Anderson, Charleston, SC (US); Daniel C. Hillenbrand, Batesville, IN (US); Joe D. McGuinness, Goose Creek, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/874,681

(22) Filed: Jun. 5, 2001

Related U.S. Application Data

(63) Continuation of application No. 09/437,001, filed on Nov. 9, 1999, now Pat. No. 6,240,583, which is a continuation-in-part of application No. 09/373,116, filed on Aug. 12, 1999, now abandoned.

(51) Int. Cl.[7] ..... A47C 21/08; A61G 7/053

(52) U.S. Cl. ..... 5/662; 5/428; 5/430

(58) Field of Search ..... 5/600, 602, 621, 5/623, 426, 428, 429, 430, 662, 503.1, 658

(56) References Cited

U.S. PATENT DOCUMENTS

| | | | | |
|---|---|---|---|---|
| 421,656 A | | 2/1890 | Blanken | |
| 2,585,660 A | | 2/1952 | Kjos et al. | |
| 2,722,017 A | | 11/1955 | Burst et al. | |
| 2,817,854 A | | 12/1957 | Pratt | |
| 2,817,855 A | | 12/1957 | Pratt | |
| 3,021,534 A | | 2/1962 | Hausted | |
| 3,055,020 A | | 9/1962 | Mann | |
| 3,249,387 A | | 5/1966 | Pivacek | |
| 3,286,283 A | | 11/1966 | Bertoldo | |
| 3,312,986 A | * | 4/1967 | Fahrni et al. | 5/503.1 |
| 3,344,445 A | | 10/1967 | Crawford | |
| 3,351,962 A | | 11/1967 | Dodrill et al. | |
| 3,486,176 A | | 12/1969 | Murcott | |
| 3,585,659 A | | 6/1971 | Burst et al. | |
| 3,865,434 A | | 2/1975 | Sully | |
| 3,932,903 A | | 1/1976 | Adams et al. | |
| 3,971,083 A | | 7/1976 | Peterson | |
| 4,120,530 A | | 10/1978 | Imbro | |
| 4,439,880 A | | 4/1984 | Koncelik et al. | |
| 4,612,679 A | | 9/1986 | Mitchell | |
| 4,747,171 A | | 5/1988 | Einsele et al. | |
| 4,839,933 A | | 6/1989 | Plewright et al. | |
| 4,932,090 A | | 6/1990 | Johansson | |
| 4,993,089 A | | 2/1991 | Solomon et al. | |
| 5,038,430 A | * | 8/1991 | Bly | 5/425 |
| 5,060,327 A | * | 10/1991 | Celestina et al. | 5/662 |
| 5,084,925 A | | 2/1992 | Cook | |
| 5,195,200 A | | 3/1993 | Leoutsakos | |
| D336,578 S | | 6/1993 | Celestina | |
| 5,216,768 A | | 6/1993 | Bodine et al. | |
| 5,231,721 A | | 8/1993 | Fish | |

(List continued on next page.)

FOREIGN PATENT DOCUMENTS

| | | |
|---|---|---|
| WO | WO 82/02832 | 9/1982 |

*Primary Examiner*—Michael F. Trettel
(74) *Attorney, Agent, or Firm*—Bose, McKinney & Evans LLP

(57) ABSTRACT

A bed is provided including a frame, an accessory mount coupled to the frame, a siderail, and an ambulatory assist arm assembly. The accessory mount is configured to removably couple the siderail to the frame so that the siderail can be removed and replaced with the ambulatory assist arm assembly.

34 Claims, 11 Drawing Sheets

U.S. PATENT DOCUMENTS 5,255,403 A 10/1993 Ortiz
5,335,385 A 8/1994 Brown
5,337,430 A * 8/1994 Schlein ..... 5/662
5,347,682 A 9/1994 Edgerton, Jr.
5,381,571 A 1/1995 Gabhart
5,384,927 A * 1/1995 Mardero et al. ..... 5/662
5,388,294 A 2/1995 Reeder
5,394,581 A 3/1995 Leoutsakos
5,418,988 A * 5/1995 Iura ..... 5/430
5,485,699 A 1/1996 Gabhart
5,586,352 A 12/1996 O'Brien et al.
5,678,267 A 10/1997 Kinder
5,689,839 A 11/1997 Langanière
5,781,945 A 7/1998 Scherer et al.
5,787,530 A 8/1998 Brix
5,802,636 A 9/1998 Corbin et al.
5,806,111 A 9/1998 Heimbrock et al.
5,832,549 A 11/1998 Le Pallec et al.
5,836,026 A 11/1998 Reed
5,878,452 A 3/1999 Brooke et al.
6,058,531 A * 5/2000 Carroll ..... 5/430
6,240,583 B1 * 6/2001 Brooke et al. ..... 5/662

* cited by examiner

AMBULATORY ASSIST ARM FOR A BED

This application is a continuation of U.S. application Ser. No. 09/437,001, filed Nov. 9, 1999, now U.S. Pat. No. 6,240,583, which is a continuation-in-part of U.S. application Ser. No. 09/373,116, filed on Aug. 12, 1999, now abandoned the disclosures of which are expressly incorporated by reference herein.

BACKGROUND AND SUMMARY OF THE INVENTION

The present invention relates to a bed including a removable siderail.

According to the present invention, a bed is provided including a frame, first and second spaced-apart mounting tubes coupled to the frame, a siderail, and an ambulatory assist arm. The siderail includes a rail member and first and second mounting bars. The first and second mounting tubes are configured to receive the first and second mounting bars to couple the siderail to the frame. The ambulatory assist arm assembly includes an ambulatory assist arm and first and second mounting bars. The first and second mounting tubes are configured to receive the first and second mounting bars of the ambulatory assist arm to couple the ambulatory assist arm assembly to the frame.

According to another aspect of the invention, another bed is provided. The bed includes a frame, an accessory mount coupled to the frame, a siderail, and an ambulatory assist arm assembly. The siderail is configured to block egress of a patient from the bed. The accessory mount is configured to coupled the siderail to the frame. The ambulatory assist arm assembly includes an ambulatory assist arm having a grip adapted to be gripped by a patient to assist the patient's egress from the bed. The accessory mount is configured to couple the ambulatory assist arm to the frame.

According to another aspect of the invention, a bed is provided including a frame, an accessory mount coupled to the frame, a siderail, and an accessory member substantially different than the siderail. The siderail is configured to block egress of a patient from a patient rest surface. The accessory mount is configured to removably couple the siderail to the frame. The accessory mount is configured to couple the accessory member to the frame with the siderail removed.

According to another aspect of the invention, a bed is providing including a frame, a headboard coupled to the frame, a footboard coupled to the frame, an accessory mount coupled to the frame between the headboard and footboard, and first and second substantially different accessory members. The accessory mount is configured to removably couple the first accessory to the frame. The accessory mount is configured to couple the second accessory member to the frame when the first accessory member is removed.

According to another aspect of the invention, a method of adjusting the configuration of a bed is provided. The method includes the steps of providing a bed. The bed has a frame, an accessory mount coupled to the frame, a siderail coupled to the frame by the accessory mount, and an accessory member substantially different than the siderail. The method further includes the steps of removing the siderail from the frame and coupling the accessory member to the frame with the accessory mount.

Additional features of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
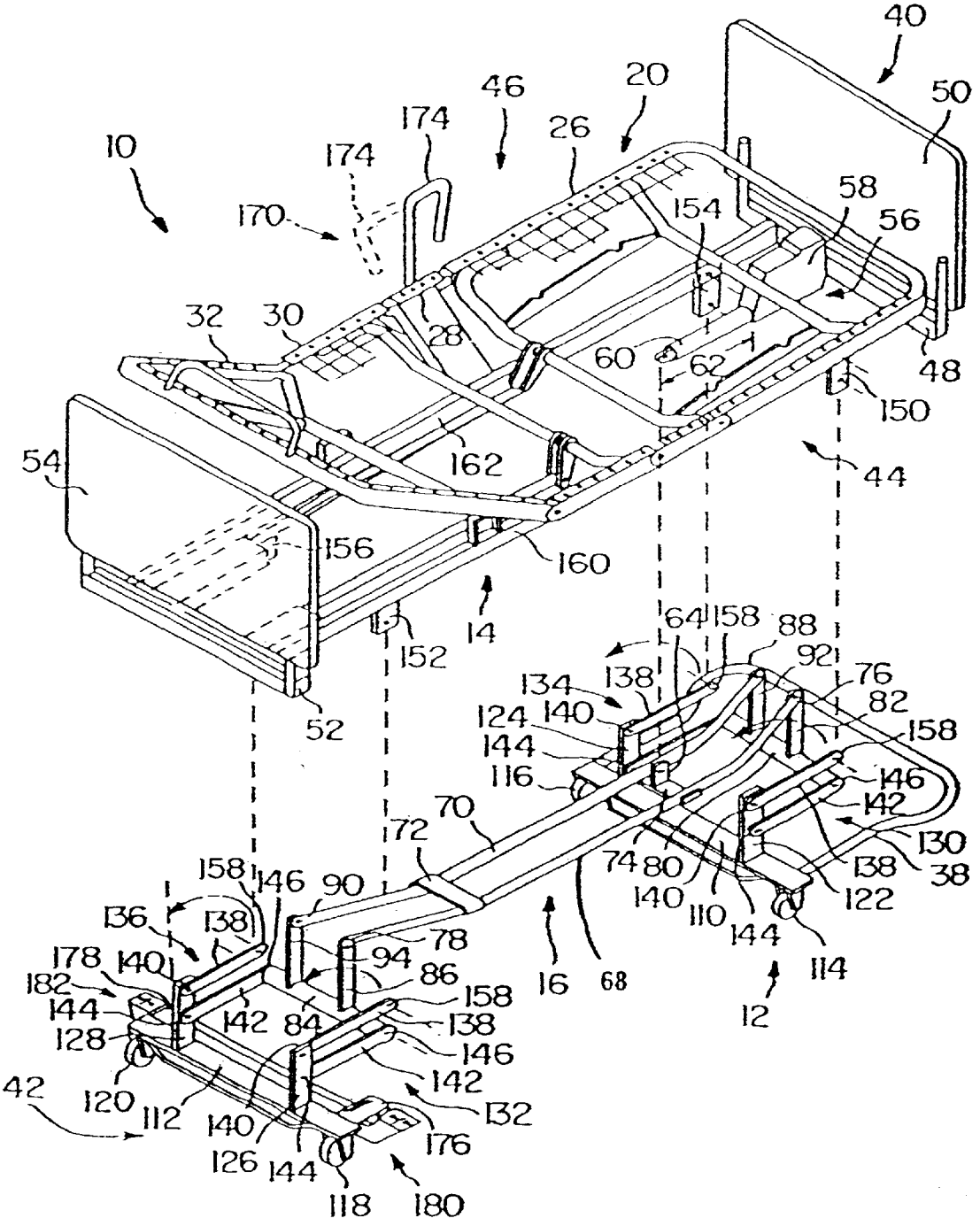
FIG. 1 is an exploded perspective view of a long term care bed in accordance with the present invention showing a base frame engaging the floor, an intermediate frame coupled to the base frame for upward and downward movement relative to the base frame and to the floor, and a bed deck carried by the intermediate frame, the deck being configured to support a mattress (not shown) for carrying a long term care resident.

A long term care bed 10 includes a base frame 12 and an intermediate frame 14 coupled to base frame 12 by a drive assembly 16 as shown in FIG. 1. Drive assembly 16 moves intermediate frame 14 between a raised position spaced apart from base frame 12 and spaced apart from the floor 18 beneath base frame 12, as shown best in FIG. 2*a*, and a lowered position resting on base frame 12, as shown best in FIG. 2*b*. A bed deck 20 is connected to intermediate frame 14 and carries a mattress 22 having a generally upwardly-facing sleeping surface 24. Thus, as drive assembly 16 moves intermediate frame 14 between the raised position and the lowered position, sleeping surface 24 and a long term care resident (not shown) resting on sleeping surface 24 move relative to base frame 12 and floor 18.

Deck 20 is an articulating deck including longitudinally spaced-apart head, seat, thigh, and leg sections 26, 28, 30, 32 as shown in FIG. 1. Head section 26, thigh section 30, and leg section 32 are each individually movable relative to one another, relative to seat section 28, and relative to intermediate frame 14, and seat section 28 is fixed to intermediate frame 14 by a bar 34. While deck 20 is an articulating deck having a plurality of movable deck sections 26, 30, 32, it is within the scope of the invention as presently perceived for deck 20 to be a unitary deck having no movable sections, for deck 20 to have only one movable deck section, and for deck 20 to have any desired number of movable deck sections. Thus, any desired type of bed deck can be carried by intermediate frame 14 without exceeding the scope of the invention as presently perceived.

Bed 10 includes a head end 40, a foot end 42, a first side 44, and a second side 46 as shown in FIG. 1. A head frame 48 is attached to head end 40 of intermediate frame 14 as shown in FIGS. 1–3 and a head board 50 is attached to head frame 48. A bumper 38 is connected to base frame 12 to protect head board 50 and to ensure that head end 40 of bed 10 is always spaced apart from adjacent walls 164 a sufficient distance to allow for the movement of intermediate frame 14 relative to base frame 12 without head board 50 or intermediate frame 14 touching walls 164 near bed 10. In addition, a foot frame 52 is attached to foot end 42 of intermediate frame 14 and a foot board 54 is attached to foot frame 52.

Figure 2A:
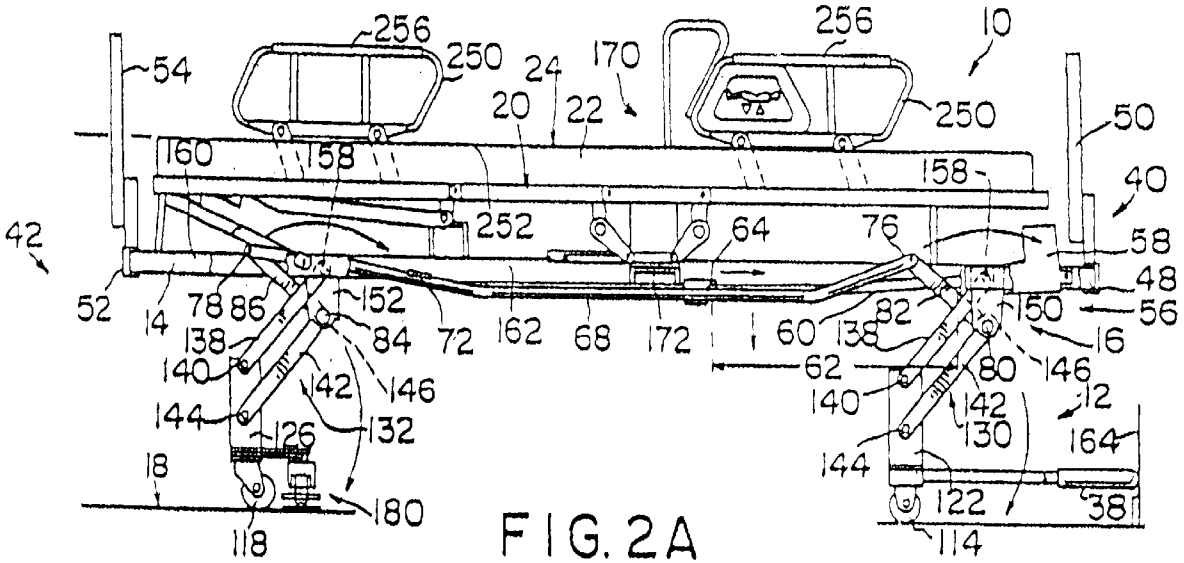
FIG. 2*a* is a side elevation view of the bed of FIG. 1 with portions broken away showing the deck carrying a mattress and the intermediate frame moved to a raised position spaced-apart above the base frame.
Figure 2B:
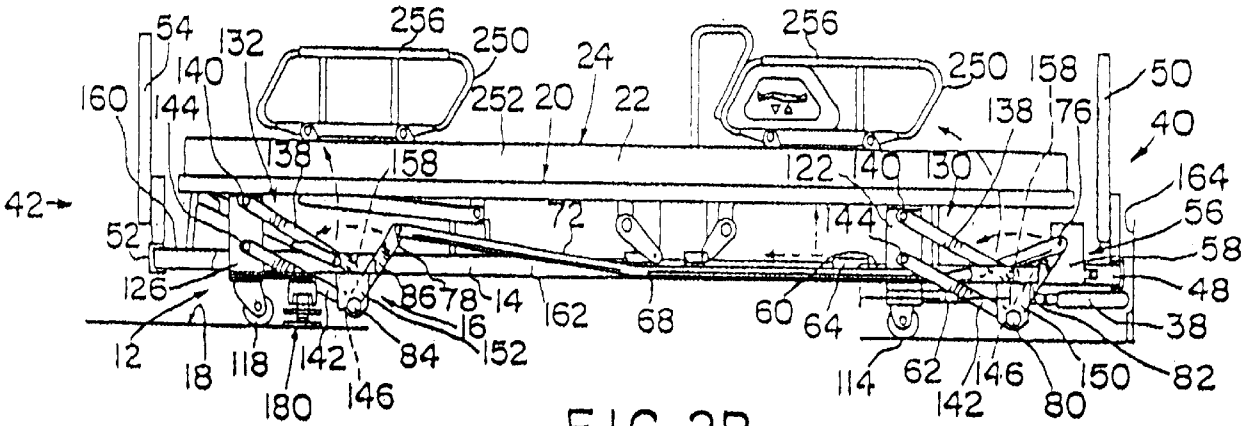
FIG. 2*b* is a view similar to FIG. 2*a* showing the intermediate frame moved to a lowered position resting on the base frame so that the distance between a generally upwardly-facing sleeping surface of the mattress and the floor is minimized.

Drive assembly 16 includes a driver 56 having a motor 58 attached to head frame 48 and a linear actuator 60 having a length 62 that extends and retracts in response to the operation of motor 58 as shown in FIGS. 2*a* and 2*b*. It is well known in the hospital bed art that electric drive motors with various types of transmission elements including lead screw drives and various types of mechanical linkages may be used to cause relative movement of portions of hospital beds and stretchers. As a result, the term "driver" and "driver 56" when used relative to drive assembly 16 in the specification and in the claims is intended to cover all types of mechanical, electromechanical, hydraulic, and pneumatic drivers that can extend and retract to raise and lower intermediate frame 14 relative to base frame 12, including manual cranking mechanisms of all types, and including combinations thereof such as hydraulic cylinders in combination with electromechanical pumps for pressurizing fluid received by the hydraulic cylinders.

Motor 58 of driver 56 is attached to head frame 48 thereby fixing motor 58 relative to intermediate frame 14 and actuator 60 is coupled to motor 58 and to a flange 64 of drive assembly 16 so that as motor 58 causes actuator 60 to extend, flange 64 is pushed away from head frame 48, and as motor 58 causes actuator 60 to retract, flange 64 is pulled toward head frame 48. Flange 64 is movable relative to base frame 12 and relative to intermediate frame 14 and drive assembly 16 is configured so that as flange 64 moves relative to head frame 48, and intermediate frame 14 moves relative to base frame 12 between the raised and lowered positions.

Drive assembly 16 further includes spaced-apart, generally parallel, and longitudinally-extending first and second bars 68, 70 as shown best in FIG. 1 Bars 68, 70 are connected to one another by a first brace 72 and a second brace 74. Flange 64 is fixed to second brace 74. Thus, as flange 64 is pushed away from or pulled toward head frame 48, second brace 74 and bars 68, 70 also move away from or toward head frame 48 as shown in FIGS. 2*a* and 2*b*.

First bar 68 has a first end 76 and a second end 78 as shown in FIG. 1. First end 76 is connected to a head end shaft 80 by a link 82 fixed to shaft 80 and extending radially outwardly therefrom. Second end 78 is connected to a foot end shaft 84 by a link 86 fixed to shaft 84 and extending radially outwardly therefrom.

Likewise, second bar 70 has first and second ends 88, 90. First end 88 is connected to shaft 80 by a link 92 fixed to shaft 80 and extending radially outwardly therefrom and second end 90 is connected to shaft 84 by a link 94 fixed to shaft 84 and extending radially outwardly therefrom.

Base frame 12 includes a head end transverse member 110 extending generally transversely between two head end casters 114, 116 and a foot end transverse member 112 extending generally transversely between two foot end casters 118, 120 as shown in FIG. 1. Transversely spaced-apart first and second head end brackets 122, 124 are fixed to member 110 and extend generally upwardly therefrom and transversely spaced-apart first and second foot end brackets 126, 128 are fixed to member 112 and extend generally upwardly therefrom.

Drive assembly 16 includes fours sets 130, 132, 134, 136 of parallel links, each set 130, 132, 134, 136 being associated with one of brackets 122, 124, 126, 128, respectively, as shown in FIG. 1. Each set 130, 132, 134, 136 includes a first link 138 having a first end 140 pivotally coupled to its respective bracket 122, 124, 126, 128 and a second link 142 having a first end 144 vertically spaced apart beneath first end 140 of first link 138 and pivotally coupled to its respective bracket 122, 124, 126, 128. A second end 146 of each second link 142 is fixed to its respective shaft 80, 84 so that shaft 80, 84 is restrained against rotation relative to link 142. Thus, as flange 64 is pushed away from head frame 48, bars 68, 70 move toward foot end 42 of bed 10 and links 82, 86, 92, 94 move toward foot end 42 of bed 10 and are pushed upwardly by second links 142 as second links 142 are rotated about their respective first ends 144.

Intermediate frame 14 includes four generally downwardly extending flanges 150, 152, 154, 156. Second end 146 of each second link 142 is pivotally coupled to its respective flange 150, 152, 154, 156 as shown in FIG. 1. In addition, a second end 158 of each first link 138 is pivotally coupled to its respective flange 150, 152, 154, 156 and is spaced apart from and positioned to lie above second end 146 of its respective second link 142. Thus, each set 130, 132, 134, 136 of links defines a parallelogram mechanism connecting intermediate frame 14 to base frame 12 so that as flange 64 of drive assembly 16 moves relative to head frame 48, flanges 150, 152, 154, 156 of intermediate frame 14 move upwardly and downwardly relative to base frame 12 and floor 18. Sets 130, 132, 134, 136 of links will be referred to hereinafter as parallelogram mechanisms 130, 132, 134, 136.

When actuator 60 is extended, maximizing length 62 as shown in FIG. 2*a*, intermediate frame 14 is in the raised position spaced apart from base frame 12. Moving actuator 60 to the extended position maximizes the distance between flange 64 of drive assembly 16 and head frame 48 pushing bars 68, 70 toward foot end 42 of base frame 12 and away from head end 40 of base frame 12. Pushing bars 68, 70 toward foot end 42 of base frame 12 pushes links 82, 86, 92, 94 toward foot end 42, links 82, 86 and links 92, 94 pull shafts 80, 84, respectively, toward foot end 42, and the movement of shafts 80, 84 rotates first and second links 138, 142 of each parallelogram mechanism 130, 132, 134, 136 upwardly, moving flanges 150, 152, 154, 156 and intermediate frame 14 upwardly.

Moving actuator 60 to the retracted position minimizes the distance between flange 64 of drive assembly 16 and head frame 48 pulling bars 68, 70 toward head end 40 of base frame 12 and away from foot end 40 of base frame 12 as shown in FIG. 2*b*. Pulling bars 68, 70 toward head end 40 of base frame 12 pulls links 82, 86, 92, 94 toward head end 40, links 82, 86 and links 92, 94 push shafts 80, 84, respectively, toward head end 40, and the movement of shafts 80, 84 rotates first and second links 138, 142 of each parallelogram mechanism 130, 132, 134, 136 downwardly, moving flanges 150, 152, 154, 156 and intermediate frame 14 downwardly.

When actuator 60 is retracted, minimizing length 62 as shown in FIG. 2*b*, intermediate frame 14 is in the lowered position having side members 160, 162 of intermediate frame 14 resting on transverse members 110, 112 of base frame 12. It also can be seen that when intermediate frame 14 is in the lowered position, flanges 150, 152, 154, 156 extend downwardly from intermediate frame 14 and past transverse members 110, 112 of base frame 12 so that second end 158 of first link 138 of each parallelogram mechanism 130, 132, 134, 136 is closer to floor 18 than first end 144 of second link 142 of each parallelogram mechanism 130, 132, 134, 136.

As described above, bumper 38 is fixed to head end 40 of base frame 12 as shown in FIGS. 1, 2*a*, and 2*b*. As intermediate frame 14 moves from the raised position, shown in FIG. 2*a*, to the lowered position, shown in FIG. 2*b*, intermediate frame also translates toward head end 40 of bed 10. Bumper 38 is positioned to lie so that bumper 38 extends farther in the direction of head end 40 of bed 10 than intermediate frame 14 extends at any point during movement of intermediate frame 14 between the raised position and the lowered position. Thus, as shown best in FIG. 2*b*, bumper 38 operates to space bed 10 a sufficient distance away from a wall 164 adjacent to head end 40 of bed 10 so that intermediate frame 14 can move relative to base frame 12 between the raised position and the lowered position without touching wall 164.

An ambulatory assist arm 170 is attached to intermediate frame 14 of bed 10 as shown in FIGS. 1, 2*a*, 3*a*, and 3*b*. Arm 170 includes a first end 172 coupled to intermediate frame 14 and arm 170 extends generally upwardly therefrom terminating at a grip 174 spaced apart from first end 172 and positioned to lie above sleeping surface 24 of mattress 22 and above siderail 250 as shown in FIGS. 2*a*and 2*b*. Because first end 172 is coupled to intermediate frame 14, movement of intermediate frame 14 relative to base frame 12 does not affect the position of grip 174 relative to sleeping surface 24. However, ambulatory assist arm 170 is rotatable relative to intermediate frame 14 so that the orientation of grip 174 relative to sleeping surface 24 can be adjusted side-to-side as shown, for example, in FIG. 1.

Grip 174 of ambulatory assist arm 170 provides a secure structure for the resident to hold during ingress to and egress from sleeping surface 24 of bed 10. Grip 174 is coupled to intermediate frame 14 and moves with intermediate frame 14 and mattress 22 during movement of intermediate frame 14 between the raised and lowered positions so that the resident will have a consistent and reliable support to grasp when entering or exiting bed 10.

Figure 3B:
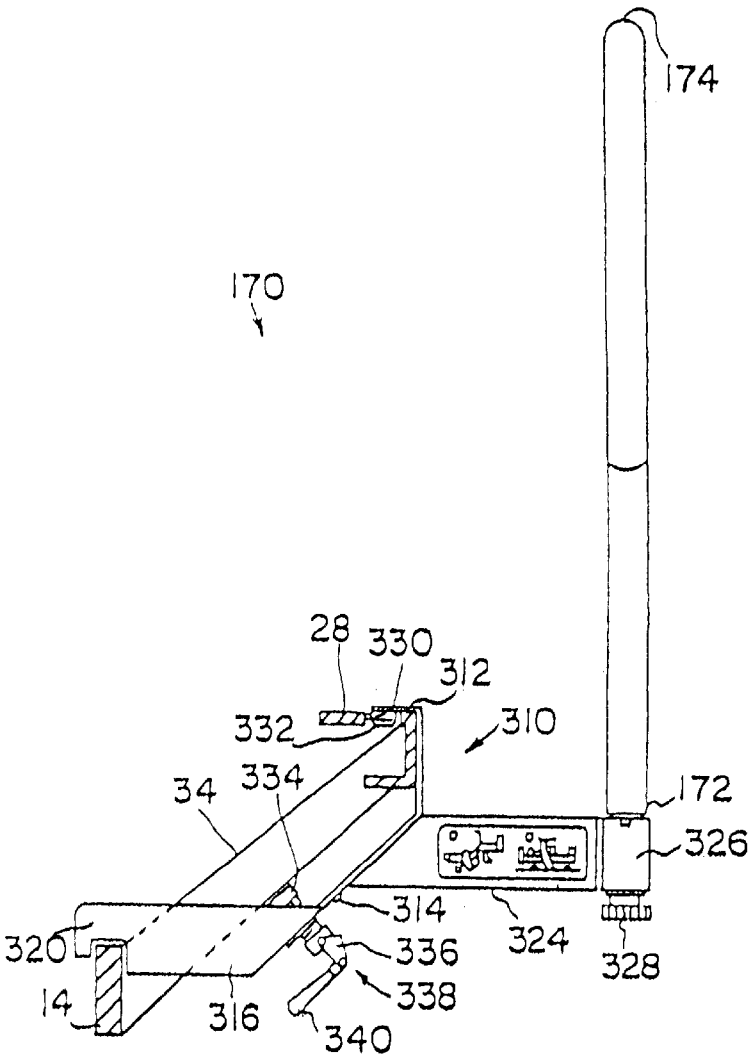
FIG. 3*b* is a diagrammatic side elevation view with portions broken away of the ambulatory assist arm connected to the bed.
Figure 3A:
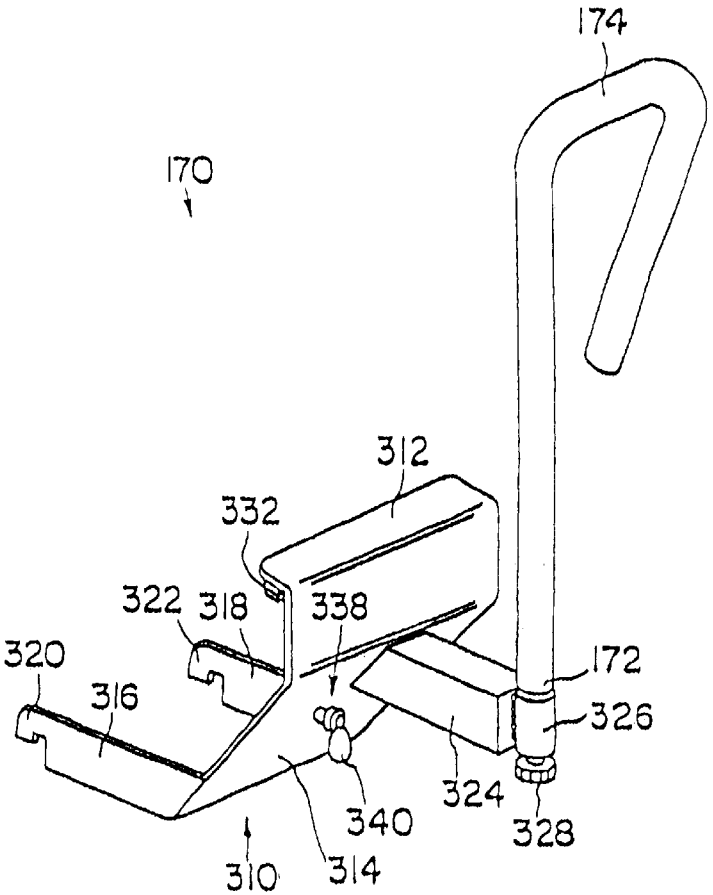
FIG. 3*a* is a perspective view of an ambulatory assist arm of FIG. 1 showing a bracket for connecting the ambulatory assist arm to the bed, a handle positioned to lie above the bracket, and a knob beneath the bracket and movable to an adjusting position allowing the handle to rotate relative to the bracket in order to adjust the side-to-side position of the handle relative to the bracket.

Ambulatory assist arm 170 is mounted to bed 10 by a bracket 310 shown in FIGS. 3*a* and 3*b*. Bracket 310 includes an upper flange 312, a body portion 314 extending downwardly from upper flange 312, and spaced-apart first and second lower flanges 316, 318 extending inwardly from body portion 314 toward intermediate frame 14, each flange 316, 318 terminating in a hook 320, 322, respectively. A bar 324 extends outwardly from body portion 314 and a socket 326 is attached to the outward end of bar 324. First end 172 of ambulatory assist arm 170 is mounted in socket 326 and a set screw 328 can be moved to a locking position fixing ambulatory assist arm 170 relative to bracket 310, intermediate frame 14, and sleeping surface 24. Set screw 328 can be loosened and moved to a releasing position allowing ambulatory assist arm 170 to rotate in socket 326.

Although the locking mechanism for locking ambulatory assist arm 170 relative to bar 324 and thus to bracket 310, intermediate frame 14, and sleeping surface 24 is set screw 328 and socket 326, the locking mechanism can include a clamp, a spring loaded lock, a locking pin, or any suitable device for fixing ambulatory assist arm 170 relative to bracket 310 and allowing for the adjustment of the position of ambulatory assist arm 170 relative to bracket 310 while bracket 310 is coupled to intermediate frame 14. Thus, ambulatory assist arm 170 has first end 172 coupled to intermediate frame 14 and grip 174 spaced apart from first end 172 and positioned to lie above sleeping surface 24. Arm 170, and thus grip 174, is fixed relative to intermediate frame 14 when the locking mechanism is in the locking position and is rotatable relative to intermediate frame 14 when the locking mechanism is in the releasing position so that the orientation of grip 174 relative to sleeping surface 24 can be adjusted, even when bracket 310 is mounted to bed 10.

Seat section 28 includes a plurality of apertures 330 extending generally downwardly as shown in FIGS. 1 and 3*b*. Pins 332 are mounted to upper flange 312 and extend downwardly therefrom so that when bracket 310 is mounted to bed 10, pins 332 are received by apertures 330. In addition, lower flanges 316, 318 straddle bar 34 connecting intermediate frame 14 to seat section 28 and hooks 320, 322 hook around intermediate frame 14 as shown best in FIG. 3*b*. Thus, hooks 320, 322 engage intermediate frame 14 and cooperate with pins 332 to mount bracket 310, and ambulatory assist arm 170, to bed 10. Although pins 332 extend through apertures 330 to connect bracket 310 to seat section 38, it is within the scope of the invention as presently perceived to employ hooks that hook over seat section 38 in a manner similar to hooks 320, 322 over intermediate frame 14 or similar attaching mechanisms to connect bracket 310 to seat section 38. However, use of pins 332 in apertures 330 provides additional support in the longitudinal direction so that bracket 310 and ambulatory assist arm 170 do not move toward head end 40 or foot end 42 during use.

Bracket 310 is locked to bed 10 using a locking mechanism having a plunger 334 slidably mounted to body portion 314 for movement between an inward locking position engaging bar 34 when bracket 310 is mounted to bed 10 as shown in FIG. 3*b* and an outward position spaced apart from bar 34. A cam 336 has a first end engaging plunger 334 and a second end engaging body portion 314. Cam 336 cooperates with plunger 334 and bracket 310 to hold bracket 310 and, thus, ambulatory assist arm 170 snugly against bed 10. When plunger 334 is in the locking position, bracket 310 is fixed to bed 10.

A lever mechanism 338 is coupled to plunger 334 and body portion 314 as shown in FIGS. 3*a* and 3*b*. Lever mechanism 338 includes a lever 340 movable between a locking position shown in FIG. 3*b* moving cam 336 and moving plunger 334 against body portion 314 and a releasing position withdrawing plunger 334 outwardly to a position spaced apart from bar 34 of bed 10. Bracket 310, and thus ambulatory assist arm 170, is only loosely connected to bed 10 when plunger 334 is in the releasing position with pins 332 being loosely received in apertures 330 and hooks 320, 322 loosely engaging intermediate frame 14 so that arm 170 can be easily removed from bed 10 when plunger 334 is in the releasing position.

Ambulatory assist arm 170 is thus easily mounted to bed 10 using bracket 310 as shown in FIG. 3*b*. When bracket 310 and arm 170 are mounted to bed 10, set screw 328 can be moved from the locking position to the releasing position allowing arm 170 to be rotated to adjust the orientation of arm 170 relative to sleeping surface 24 as shown in FIG. 1. If desired, arm 170 and bracket 310 can be easily removed from bed 10 without using tools. To do so, the caregiver simply moves lever 340 of lever mechanism 338 from the locking position to the releasing position withdrawing plunger 334 away from bar 34 so that bracket 310 can be lifted to disengage hooks 322, 324 from intermediate frame 14 and pins 332 from apertures 330 and then moved outwardly away from bed 10.

Figure 4:
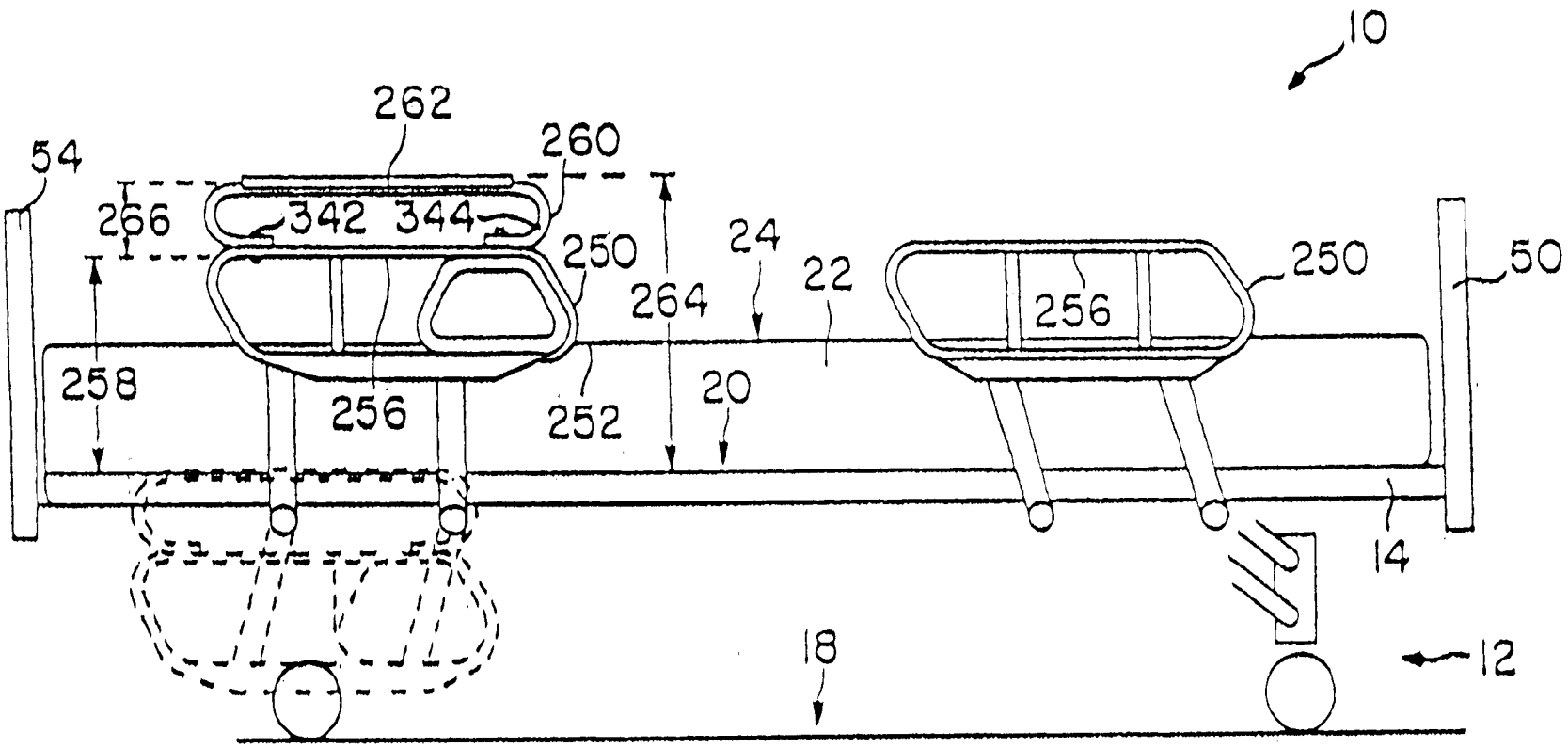
FIG. 4 is a view similar to FIG. 2*b* showing first and second siderails, the first siderail including a first embodiment of a siderail extension member coupled to a top bar of the first siderail to extend the vertical coverage provided to the resident (not shown) to minimize the inadvertent movement of the resident past the side of the sleeping surface.
Figure 10:
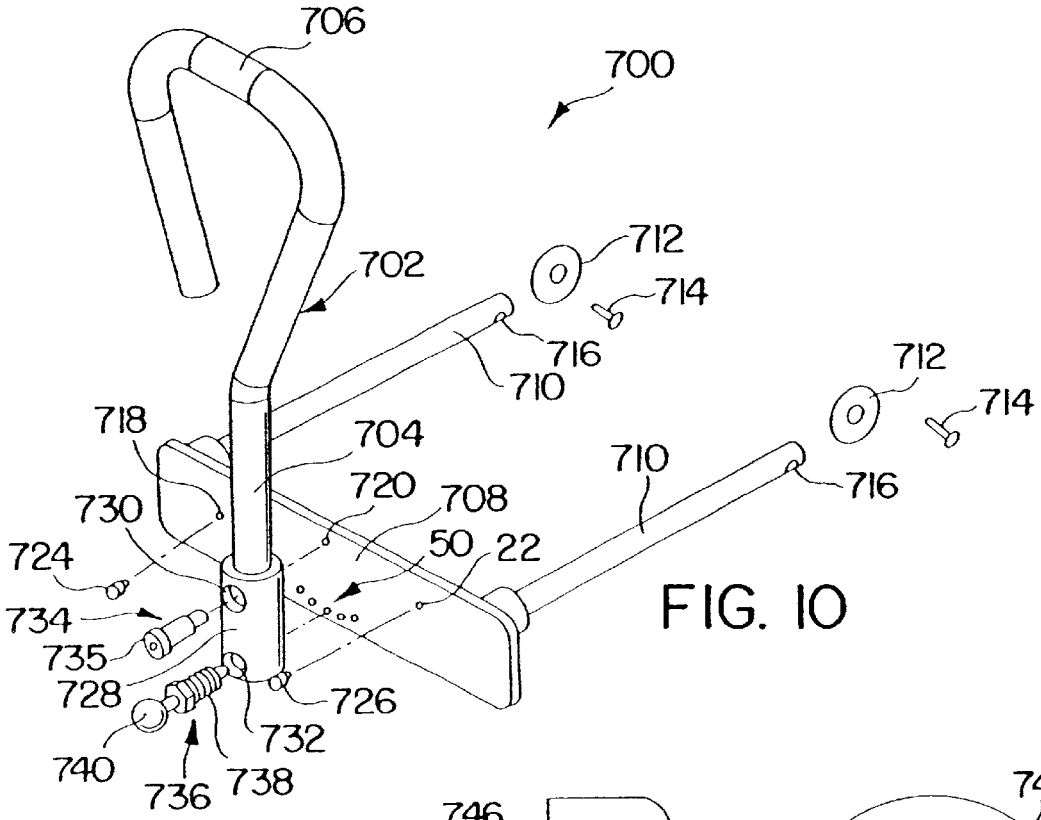
FIG. 10 is a perspective view of an ambulatory assist arm according to another embodiment of the present invention.

Bed 10 additionally includes siderails or first accessory members 250, as shown in FIGS. 2*a*, 2*b*, and 10, pivotally coupled to intermediate frame 14 for movement between a lowered position as shown (in phantom) in FIG. 4 and a raised position as shown in FIGS. 2*a*, 2*b*, and 10. Siderails 250 are positioned to lie adjacent to sides 252, 254 of sleeping surface 24 to minimize the inadvertent movement of the resident past the sides 252, 254 and off of sleeping surface 24.

Each siderail 250 includes a top rail member having top bar 256 positioned to lie along one of sides 252, 254 and above sleeping surface 24 when siderail 250 is in the raised position as shown in FIG. 4. Siderails 250 are coupled to intermediate frame 14 so that top bar 256 is a fixed distance 258 above deck 20 when siderail 250 is in the raised position. Siderails 250 include mounting bars 251 which are inserted into mounting tubes coupled to intermediate frame 14.

Siderails 250 of bed 10 provide less vertical coverage than typically found as described above. Instead, top bar 256 is spaced apart from deck 20 by distance 258 which provides insufficient coverage above sleeping surface 24 when thick mattresses are installed on deck 20. As a result, when thinner mattresses are installed on deck 20, the resident on sleeping surface 24 has a more open and comfortable environment that is more like the environment that the resident experiences at home.

When a thicker mattress is installed on deck 20, additional vertical coverage is provided by installing a siderail extension member 260, 344 onto each siderail 250 as shown for one of siderails 250 in FIG. 4. When one of siderail extension members 260, 344 is attached to siderail 250, siderail 250 and siderail extension member 260, 344 cooperate to provide vertical coverage above sleeping surface 24. Siderail extension member 260, for example, has a top bar 262 spaced apart from deck 20 by a distance 264 shown in FIG. 4 when siderail 250 is in the raised position so that use of siderail extension member 260 provides additional vertical coverage equivalent to a distance 266.

Bed 10 includes features suited for regular daily use by the general resident population of a long-term care facility. In particular, bed 10 is easy to operate both by the geriatric population and the nursing aide staff. Bed 10 will permit safe and easy positioning and egress, thereby enhancing the independence of residents. In addition, bed 10 reduces the amount of manual lifting done by the staff through easy egress and operation of the bed while they assist residents with their activities of daily living. Resident egress is assisted through the lower height of the sleeping surface 24 achieved at the lowered position than is found on conventional beds, through siderails 250, and through ambulatory assist arm 170.

Figure 5:
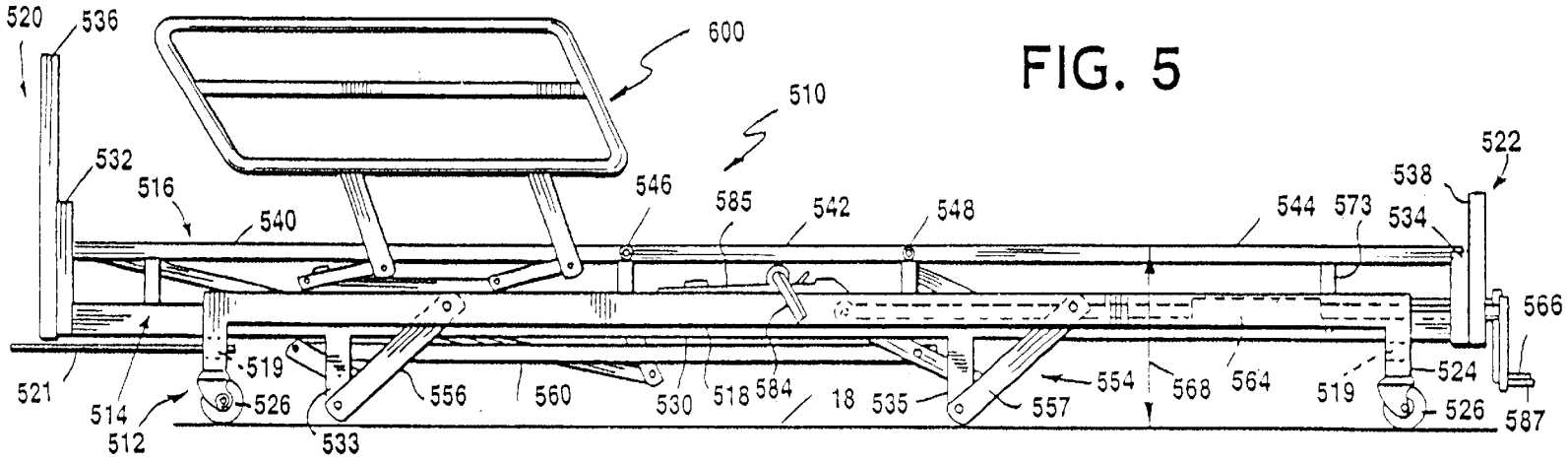
FIG. 5 is a side view of a bed frame according to another embodiment of the present invention.

FIG. 5 is a side view of a bed frame according to another embodiment of the present invention. The bed frame 510 includes a base frame 512, an intermediate frame 514, and an articulated support deck 516. As depicted, bed frame 510 can include a headboard 536 and a footboard 538 coupled to intermediate frame 514, and siderails 600 coupled to opposite sides of the articulated support deck 516. Bed frame 510 can also include casters 526 coupled to base frame 512. Bed frame 510 is suitable for long term care. In this regard, articulated support deck 516 can be configured in a variety of positions. Moreover, intermediate frame 514 allows the height of articulated support deck 16 to be readily adjustable relative to the ground. As discussed in detail below, bed frame 510, which can be economically manufactured from standard rectangular and tubular steel components, and can include an auto-contour subassembly that is selectable and easily disableable.

Base frame 512 is illustratively formed generally as a rectangle with two longitudinally extending siderails 518 and two laterally extending end rails 519 adjacent a head end 520 and foot end 522 of bed frame 510. Base frame 512 further includes downwardly depending legs 524 at its four corners, and casters 526 coupled to legs 524 which enable bed frame 510 to roll along a support surface, e.g., ground 18. Rails 518 and 519 and legs 524 are illustratively formed from standard rectangular or tubular steel members that can welded, bolted or otherwise coupled together to form base frame 512.

A wall stop or bumper 521 is formed from a generally U-shaped rod and can be coupled to base frame 512 adjacent head end 520 by pins or bolts (not shown).

Illustratively, opposite ends of U-shaped bumper 521 extend through spaced apart apertures in end rails 519. Bumper 521 keeps bed frame 510 away from wall surfaces so that movement of base frame 512, intermediate frame 514, and/or articulated support deck 516 cannot contact and damage the surface of an adjacent wall. Bumper 521 can be coupled to main frame 512 relatively low to ground 18 so that it will contact wall surfaces where they tend to be the strongest and often have protective molding. Furthermore, bumper 521 can be formed from cost-effective, readily available, standard components and can be installed at the final destination of bed frame 510.

Intermediate frame 514 is also illustratively formed with a generally rectangular shape, with two longitudinally extending siderails 530 and two laterally extending end rails (not shown) adjacent head end 520 and foot end 522. Intermediate frame 514 further includes upwardly extending head posts 532, adjacent head end 520, and upwardly extending foot posts 534 adjacent foot end 522. Intermediate frame 514 further includes two downwardly extending front support posts 533 and two downwardly extending rear support posts 535. Siderails 530, end rails (not shown), upwardly extending posts 532, 534, and downwardly extending posts 533 and 535 are illustratively formed from standard rectangular or tubular steel members that can be welded, bolted or otherwise coupled together to form intermediate frame 514. A headboard 536 can be coupled to posts 532 and a foot board 538 can be coupled to posts 534 by any conventional means such as pins or bolts (not shown).

Articulated support deck 516 includes a head deck portion 540, a seat deck portion 542, and a foot deck portion 544 that are coupled together by a head-seat pivot 546 and a seat-foot pivot 548. Deck portions 540, 542 and 544 have radiused corners 550 and 552 (see FIGS. 13 and 14) adjacent pivots 546 and 548 which serve to reduce the possibility of pinching during articulation of articulated support deck 516. Wedge comers 552 allow for access to end posts 532 and 534 which, when they are formed from tubes, can serve as sockets for an i.v. stand or other equipment (not shown). Wedge corners 552 illustratively allow the use of mattresses with different lengths on the deck.

Figure 6:
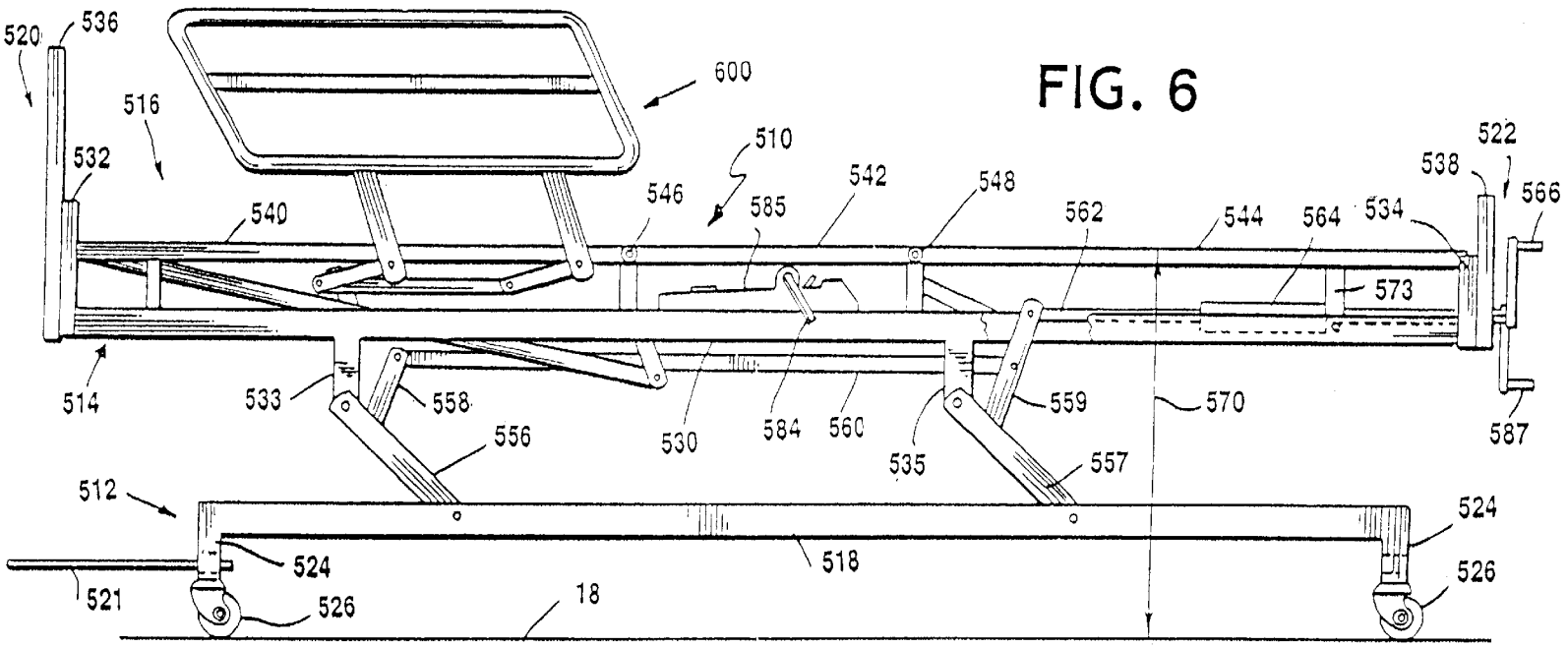
FIG. 6 is a side view of the bed frame of FIG. 5, showing the intermediate frame elevated relative to the base frame.

FIG. 6 is a side view of the bed frame of FIG. 5, showing the intermediate frame elevated relative to the base frame. Intermediate frame 514 is coupled to base frame 512 by a frame linkage assembly 554 as best shown in FIG. 6. Frame linkage assembly 554 provides for raising and lowering of intermediate frame 514 with respect to base frame 512, and includes a parallelogram linkage having rotating support arms 556 and 557 pivotally coupled between base frame siderails 518 and the downwardly extending posts 533 and 535, respectively, coupled to intermediate frame siderails 530. Linkage assembly 554 further includes drive arms 558 and 559 that are rotatably coupled to support arms 556 and 557 respectively, and are coupled together by a parallel link arm 560. Drive arm 559 is coupled to a drive rod 562 which is in turn coupled to either a vertical adjustment drive screw 564 or optionally to a drive motor (not shown).

Drive screw 564 is coupled to a vertical bed adjustment handle 566 that is located adjacent foot end 522 and provides for a convenient mechanism for raising or lowering intermediate frame 514 relative to base frame 512. When either drive screw 564 or a drive motor (not shown) moves drive rod 562 generally horizontally, it causes drive arms 558 and 559 to rotate support arms 556 and 557 and move intermediate frame 514 in a generally vertical direction relative to base frame 512. This causes articulated support deck 516 to raise from a lowered position 568 as shown in FIG. 5 to a higher position 570 as shown in FIG. 6.

Figure 7:
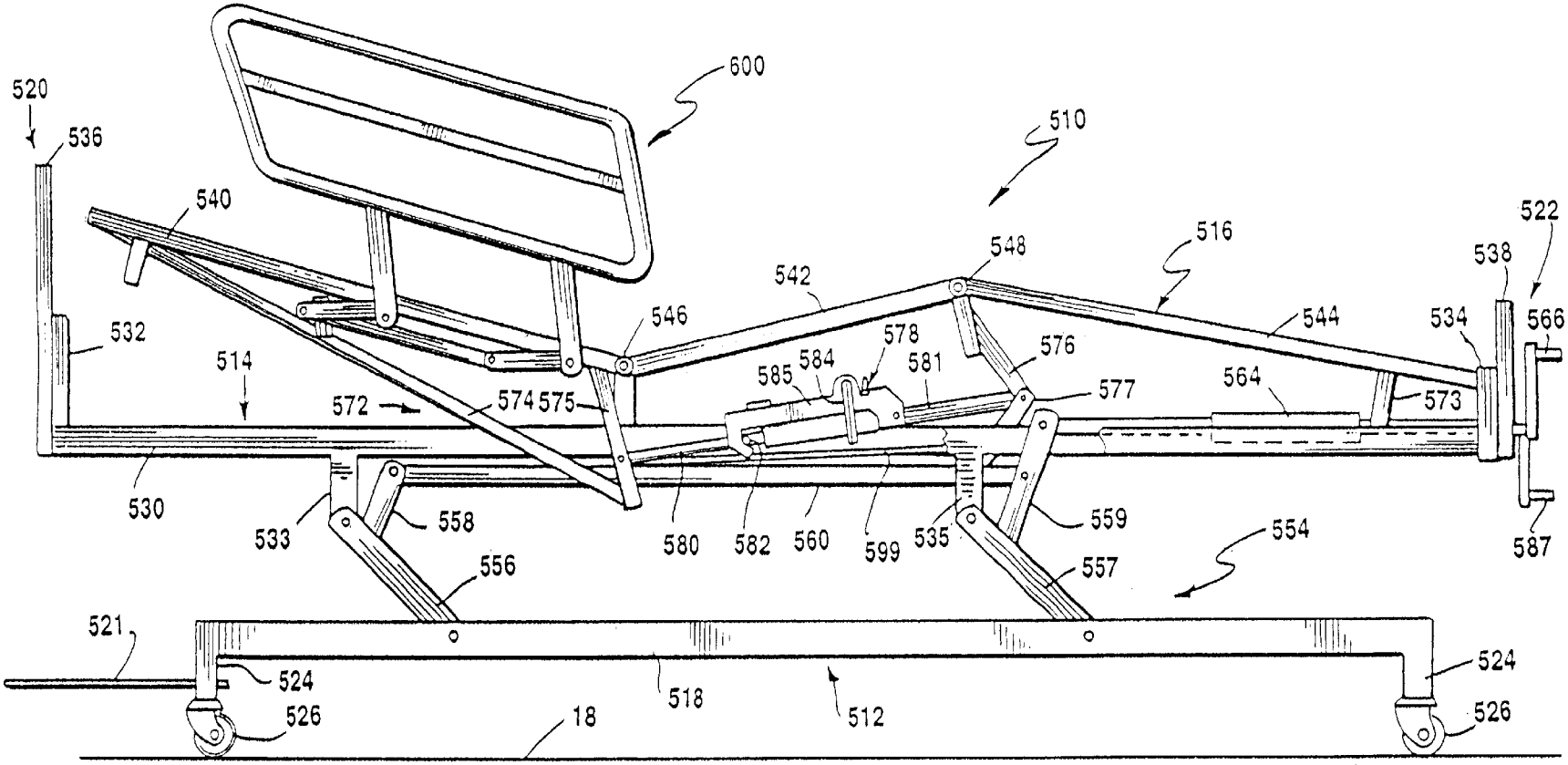
FIGS. 7–9 are side views of the bed frame of FIG. 5, showing the articulated support deck in progressively increasing non-planar positions with portions cut away to show the frame linkage assembly for movement of the intermediate frame relative to the base frame and a deck linkage assembly for articulated movement of the foot, seat, and head deck portions.
Figure 8:
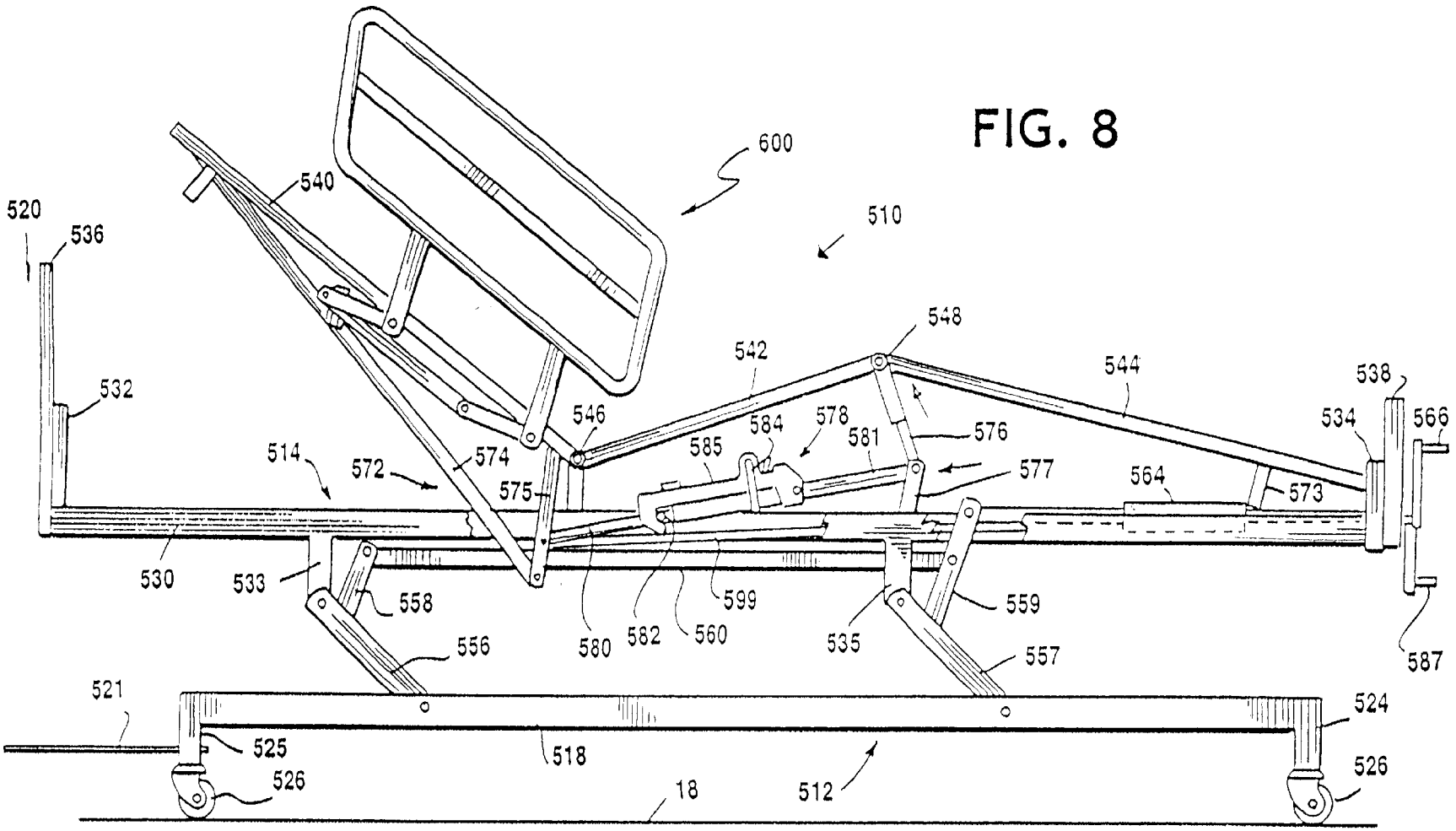
Figure 9:
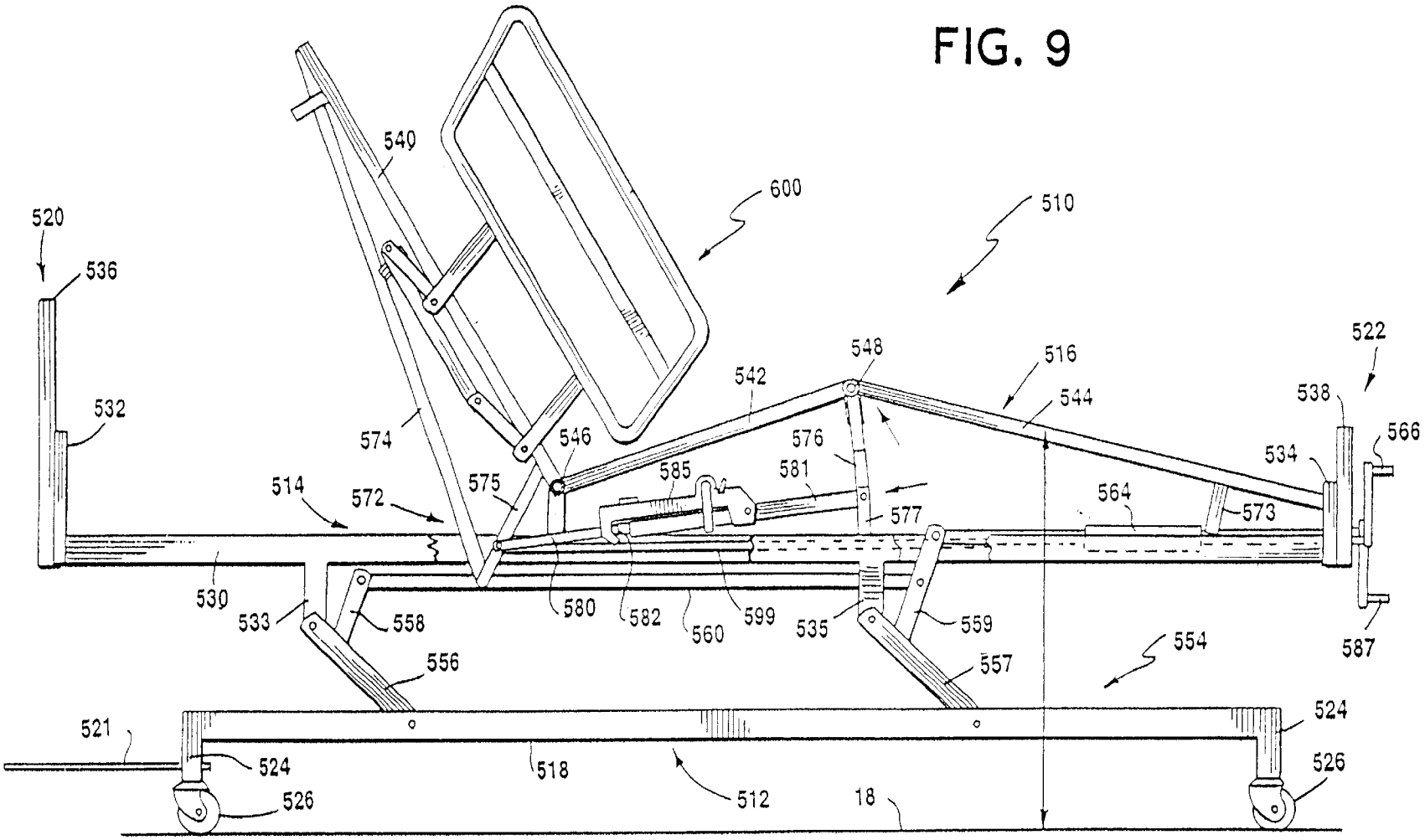

FIGS. 7–9 are side views of the bed frame of FIG. 5, showing the articulated support deck in progressively increasing non-planar positions with portions cut away to show a frame linkage assembly for movement of the intermediate frame relative to the base frame, and a deck linkage assembly for articulated movement of the foot, seat, and head deck portions.

Articulated support deck 516 is coupled to intermediate frame 514 by a deck linkage assembly 572 as shown FIGS. 7–9. Deck linkage assembly 572 includes three spaced apart head drive arms 574 having first ends coupled to head deck portion 540 adjacent head end 520. Three additional deck drive arms 575 are coupled to head deck portion 540 adjacent pivot 546. Opposite end of arms 575 are coupled to arms 574 at an acute angle as shown. Drive arms 574 and 575 are rigidly coupled both together and to head deck portion 540. Deck linkage assembly 572 also includes a drive arm 576 having a first end pivotally coupled to seat deck portion 542 and a second end which is pivotally coupled to drive arm 577. An opposite end of drive arm 577 is pivotally coupled to the intermediate frame 514. The common pivot connection of arms 576 and 577 is also coupled to a drive rod sleeve 81 of auto-contour engagement subassembly 78. Foot deck portion 44 is pivotally coupled to support arms 73 located adjacent opposite sides of foot deck portion 44. Opposite ends of arms 73 are pivotally coupled to siderails 30 of intermediate frame 14.

The progressive views of FIGS. 7–9 depict how the drive arms 576 and 577 pivot about their common pivotal point to raise seat-foot pivot 548 (and the adjacent ends of the seat deck portion 542 and foot deck portion 544), as the head deck portion 540 is inclined upward. When main drive arm 599 is moved in the direction of head end 520, it pushes against a central pair of drive arms 574 and 575 and thereby causes head deck portion 540 to pivot upward about head-seat pivot 546. As drive arms 575 rotate in an off-set manner about head-seat pivot 546, auto-contour engagement subassembly 578 pulls the pivotally connected ends of drive arms 576 and 577 so that they become substantially linearly aligned as shown in FIG. 9. In practice, it may be preferred to limit the drive arms 576 and 577 from being linearly aligned, since doing so may require an initial force to overcome forces which may tend to stabilize linear alignment. That is, when the drive arms 576 and 577 are not completely linearly aligned, the weight of the seat deck portion 542 and foot deck portion 544 will be sufficient to cause the drive arms 576 and 577 to pivot about their connected ends without any force applied by or through the auto-contour subassembly 578.

When main drive arm 599 is moved in the direction of foot end 522, the weight of the head deck portion 40 causes head deck portion 540 to pivot downward about head-seat pivot 546. As drive arms 575 rotate in an off-set manner about head-seat pivot 546, the weight of the seat deck portion 542 and the foot deck portion 544 causes drive arms 576 and 577 to pivot about their connected ends.

The ambulatory assist arm assembly or second accessory member 700 for the bed shown in FIGS. 5–9 is illustrated in FIGS. 10–14. The assist arm 702 includes a generally straight mounting end portion 704 and a generally U-shaped handle portion 706. Assist arm assembly 700 also includes a mounting plate 708 having inwardly extending mounting rods 710.

The mounting rods 710 are configured to be inserted into the same mounting tubes or accessory mount 592 that are used to mount siderails 250 when siderails 250 are removed from mounting tubes 592. (See FIGS. 13 and 14.) Illustratively, washers 712 are placed over the ends of mounting bars 710 and retaining pins 714 are inserted through apertures 416 formed in the mounting bars 710 to secure the ambulatory assist assembly 700 to mounting tubes 592. Mounting plate 708 is formed to include threaded apertures 718, 720 and 722. Stop pins 724 and 726 are coupled to apertures 718 and 722, respectively.

Ambulatory assist arm 702 includes a mounting portion 728 having a top aperture 730 and a bottom aperture 732. A pivot pin 734 extends through aperture 730 and is threadably coupled to threaded aperture 720 in mounting plate 708. Pin 734 includes an outer flange 735 so that pivot pin 734 pivotably couples the arm 702 to plate 708.

Figure 11:
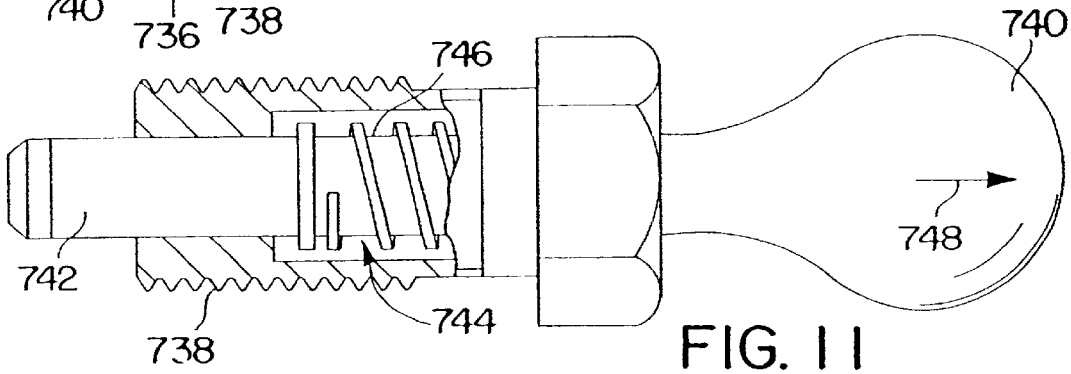
FIG. 11 is a side elevation view with portions broken away illustrating a pull pin assembly for selectively locking the ambulatory assist arm at different orientations relative to the frame of the bed.

A pull pin locking assembly 736 includes a threaded body portion 738 and a pull knob 740. Pull pin assembly 736 is best illustrated in FIG. 11. A movable pin 742 is located within an interior region 744 of body portion 738. A spring 746 biases the pin 742 to an extended position shown in FIG. 11. When handle 740 is pulled outwardly in the direction of arrow 748, pin 742 also moves in the direction of arrow 748.

Pin 742 is configured to lock the ambulatory assist arm 702 at different locations relative to the plate 708. Plate 708 is formed to include a plurality of apertures 750 configured to receive the locking pin 742 to lock the assist arm 702 in a different orientation. Illustratively, five apertures 750 are shown. However, a fewer or a greater number of apertures 750 may be used in accordance with the present invention.

Illustratively, the arm 702 may be locked in a vertical orientation, at a 12.5 degree angle, or at a 25 degree angle in either direction relative to the vertical alignment. Since pin 742 is spring loaded to an extended position, the assist arm 702 is automatically locked in the next aperture 750 when the knob 740 is released.

Figure 12:
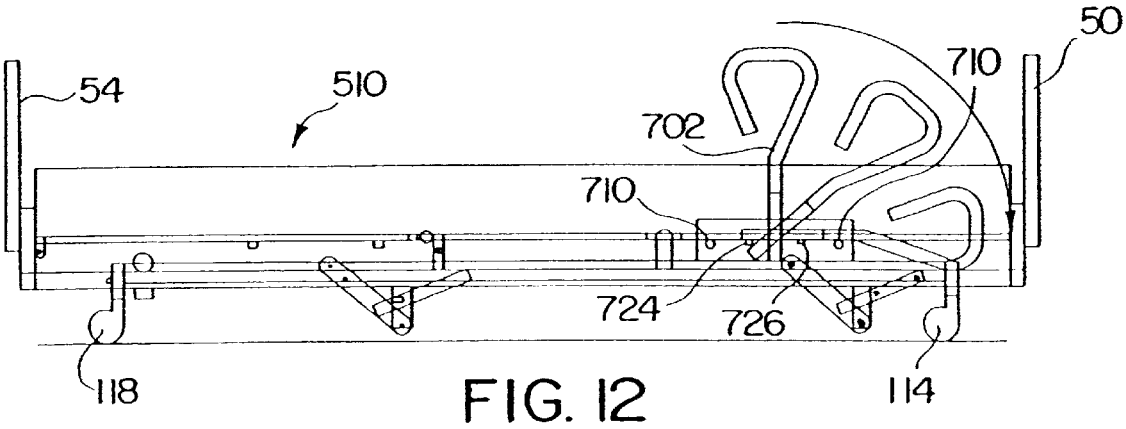
FIG. 12 is a side elevation view of the bed with the ambulatory assist arm of FIG. 10 attached to a head end of the bed.

As shown in FIG. 12, arm 702 is lockable at different orientations relative to the bed 510. Stop pins 724 and 726 are configured to hold the arm in a generally horizontal orientation. Therefore, the assist arm 702 can not pivot past a horizontal orientation in the illustrated embodiment.

Figure 13:
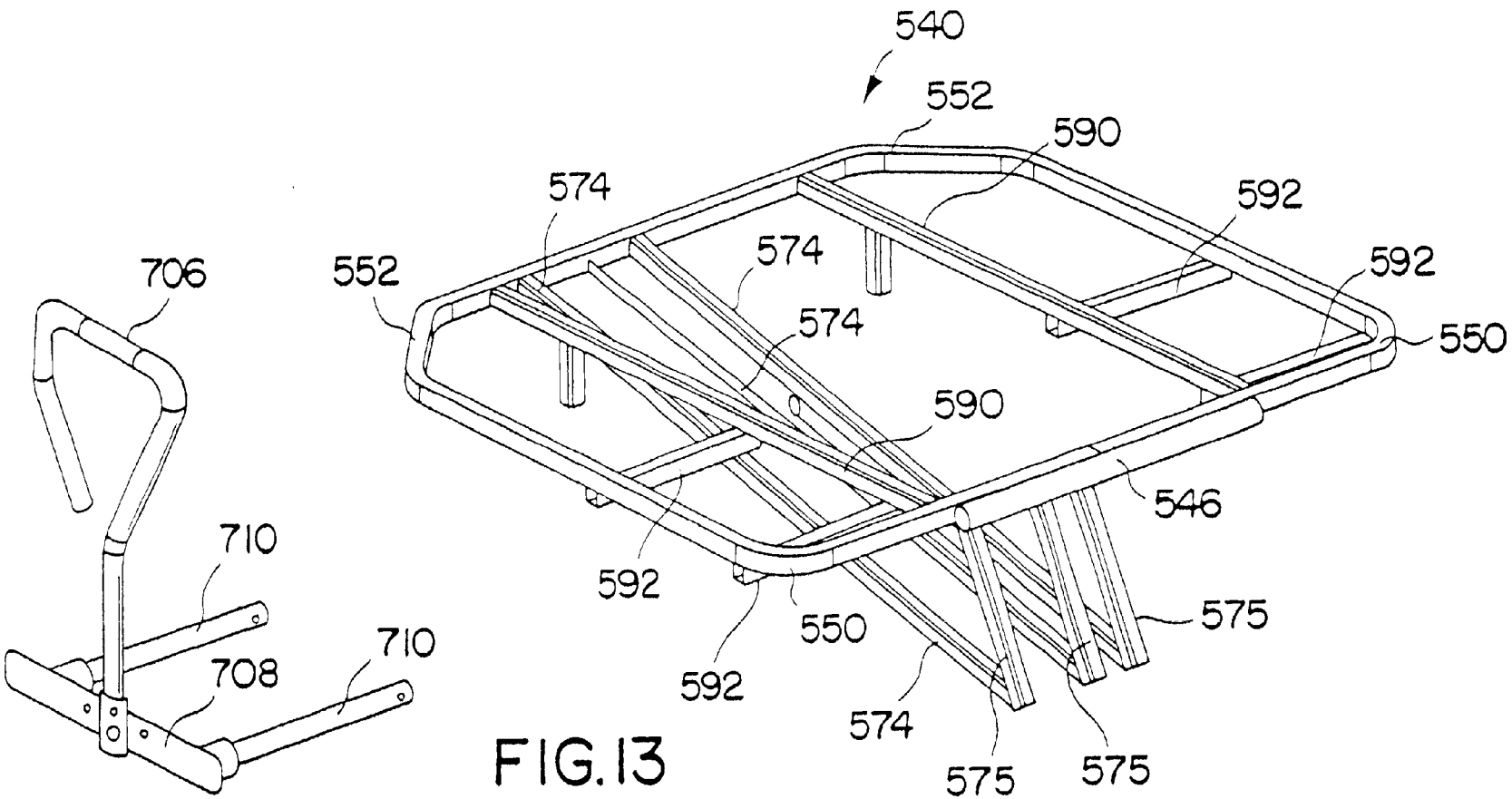
FIG. 13 is an exploded perspective view of the head end of the bed and the ambulatory assist arm of FIG. 10.

An exploded perspective view of head portion 540 of bed 510 and ambulatory assist arm 700 is shown in FIG. 13. Illustratively, rails 250 as shown in FIGS. 5–9 can be removed and replaced with assist arm 706 using same mounting tubes 592. It is appreciated that arm 706 can be placed on either or both sides of head portion 540 as desired.

Figure 14:
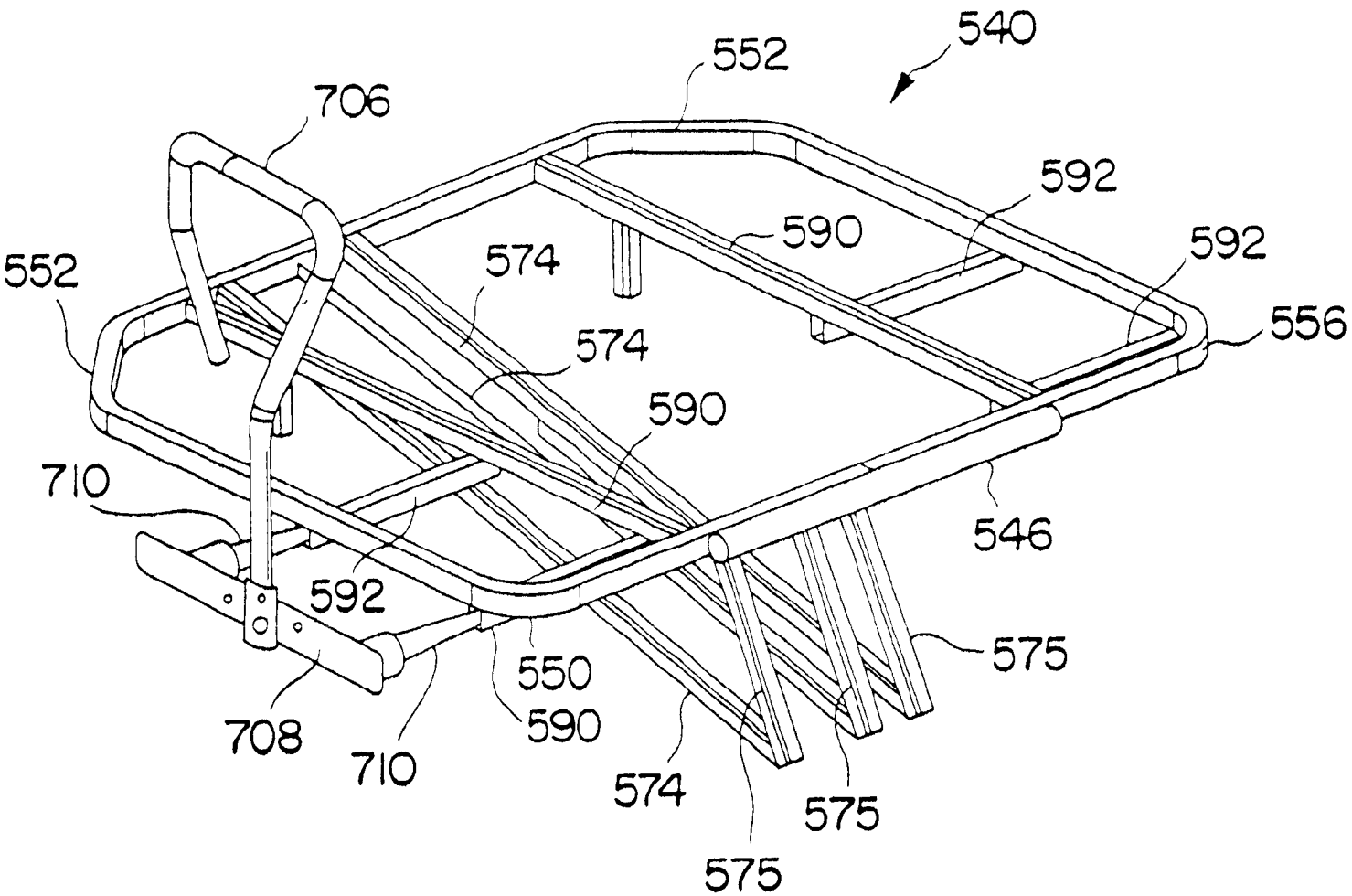
FIG. 14 is a perspective view of the head end of the bed with the ambulatory assist arm of FIG. 10 partially attached.

A perspective view of head portion 540 with extending mounting rods 710 partially extended though mounting tubes 592, is shown in FIG. 14. Illustratively, rods 710 are extended through tubes 592 to the point where retaining pins 714 engage corresponding receptors (not shown) formed in tubes 592. This ensures arm 700 is attached securely to bed 500.

Although the invention has been described in detail with reference to certain illustrated embodiments, variations and modifications exist within the scope and spirit of the invention as described and defined in the following claims.

What is claimed is:

1. A bed comprising a frame, first and second spaced-apart mounting tubes coupled to the frame, a siderail including a rail member and first and second mounting bars, the first and second mounting tubes being configured to receive the first and second mounting bars to couple the siderail to the frame, and an ambulatory assist arm assembly including an ambulatory assist arm and first and second mounting bars, the first and second mounting tubes being configured to receive the first and second mounting bars of the ambulatory assist arm to couple the ambulatory assist arm assembly to the frame.

2. The bed of claim 1, wherein the rail member is configured to move between a raised position blocking egress of the patient from the bed and a lowered position permitting egress of the patient from the bed.

3. The bed of claim 2, wherein the rail member includes a top bar positioned above a rest surface of the bed when the rail member is in the raised position.

4. The bed of claim 1, wherein in the ambulatory assist arm includes a first end coupled to the mount and a grip spaced apart from the first end and positioned to be grasped by a patient exiting the bed.

5. The bed of claim 4, wherein the ambulatory assist arm further includes an elongated portion positioned between the grip and the first end.

6. The bed of claim 4, wherein the ambulatory assist arm is configured to move between a use position with the grip positioned above a patient rest surface and a storage position with the grip positioned below the patient rest surface.

7. A bed comprising a frame, an accessory mount coupled to the frame, a siderail configured to block egress of a patient from the bed, the accessory mount being configured to couple the siderail to the frame, and an ambulatory assist arm assembly including an ambulatory assist arm having a grip adapted to be gripped by a patient to assist the patient's egress from the bed, the accessory mount being configured to couple the ambulatory assist arm to the frame.

8. The bed of claim 7, wherein the accessory mount includes a pair of tubes coupled to the frame and the siderail and ambulatory assist arm assembly include a pair of bars sized to fit in the tubes.

9. The bed of claim 7, wherein the siderail is movable between a raised position blocking egress of a patient from the bed and a lowered position permitting egress of a patient from the bed.

10. The bed of claim 7, wherein the ambulatory assist arm includes an elongated portion having a distal end and a proximal end coupled to the accessory mount and the grip is coupled to the distal end.

11. The bed of claim 7, wherein the ambulatory assist arm assembly is configured to permit movement of the grip between a use position positioned above a patient rest surface and a storage position positioned below the patient rest surface.

12. A bed comprising a frame, an accessory mount coupled to the frame, a siderail configured to block egress of a patient from a patient rest surface, the accessory mount being configured to removably couple the siderail to the frame, and an accessory member substantially different from the siderail, the accessory mount being configured to couple the accessory member to the frame with the siderail removed.

13. The bed of claim 12, wherein the siderail includes a rail member positioned to block egress of the patient from the rest surface.

14. The bed of claim 12, wherein the accessory member includes a grip positioned above the patient rest surface to assist a patient's egress from the patient rest surface.

15. The bed of claim 14, wherein the accessory member includes a vertically extending portion supporting the grip.

16. The bed of claim 12, wherein the accessory member is spaced apart from the accessory mount when the siderail is coupled to the accessory mount.

17. The bed of claim 16, wherein the siderail is spaced apart from the accessory mount when the accessory member is coupled to the accessory mount.

18. A bed comprising a frame, a headboard coupled to the frame, a footboard coupled to the frame, an accessory mount coupled to the frame between the headboard and footboard, a first accessory member, the accessory mount being configured to removably couple the first accessory to the frame, and a second accessory member substantially different from the first accessory member, the accessory mount being configured to couple the second accessory member to the frame when the first accessory member is removed.

19. The bed of claim 18, wherein the first accessory member includes a rail member positioned above a patient rest surface to block egress of a patient from the patient rest surface.

20. The bed of claim 19, wherein the second accessory member includes a grip positioned above the patient rest surface to assist a patient's egress from the patient rest surface when the first accessory member is removed.

21. The bed of claim 18, wherein the accessory mount includes a pair of tubes and the first and second accessory members includes a pair of bars sized to fit within the tubes of the accessory mount.

22. A method of adjusting the configuration of a bed, the method comprising the steps of providing a bed having a frame, an accessory mount coupled to the frame, a siderail coupled to the frame by the accessory mount, and an accessory member substantially different than the siderail, removing the siderail from the frame, and coupling the accessory member to the frame with the accessory mount.

23. The method of claim 22, wherein accessory mount includes a pair of tubes and the siderail and accessory member includes a pair of bars sized to fit in the tubes, the removing step includes sliding the bars of the siderail out of the tubes, and the coupling step includes sliding the bars of the accessory member into the tubes.

24. The method of claim 22, wherein the accessory member includes a grip positioned to assist egress of a patient from the bed.

25. The method of claim 24, further comprising the steps of moving the grip to a storage position below a patient rest surface and moving the grip to a use position above the patient rest surface.

26. A bed comprising a frame, a siderail configured to block egress of a patient from a patient rest surface, an accessory member, and means for removably coupling the siderail to the frame, the coupling means configured to removably couple the accessory member to the frame with the siderail removed.

27. The bed of claim 26, wherein the accessory member is an ambulatory assist arm having a grip adapted to be gripped by the patient to assist the patient's egress from the bed.

28. The bed of claim 27, wherein the ambulatory assist arm includes an elongated portion having a distal end and a proximal end coupled to the coupling means and the grip is coupled to the distal end.

29. The bed of claim 26, wherein the siderail is movable between a raised position blocking egress of the patient from the bed and a lowered position permitting egress of the patient from the bed.

30. The bed of claim 26, wherein the coupling means includes a pair of tubes and the accessory member includes a pair of bars sized to fit within the tubes of the coupling means.

31. A bed comprising a frame, a siderail, an accessory member, and means for coupling the siderail to the frame, the means configured to allow removal of the siderail from the frame and coupling of the accessory member to the frame.

32. The bed of claim 31, wherein the accessory member is an ambulatory assist arm having a grip adapted to be gripped by the patient to assist the patient's egress from the bed.

33. The bed of claim 31, wherein the accessory member includes a vertically extending portion supporting a grip.

34. The bed of claim 31, wherein the coupling means includes a pair of tubes and the accessory member includes a pair of bars sized to fit within the tubes of the coupling means.

* * * * *